US006008458A

United States Patent [19]

Domzalski et al.

[11] Patent Number: 6,008,458

[45] Date of Patent: Dec. 28, 1999

[54] SEALED SLIDE SWITCH

[75] Inventors: Frank M. Domzalski, Framingham; Alan J. Watson, Plymouth, both of Mass.

[73] Assignee: C & K Components, Inc., Watertown, Mass.

[21] Appl. No.: 09/050,756

[22] Filed: Mar. 30, 1998

[51] Int. Cl.[6] ..... H01H 9/04

[52] U.S. Cl. ..... 200/302.1; 200/302.3

[58] Field of Search ..... 200/6 R–6 C, 200/16 R–16 D, 547, 553, 561, 302.1, 302.3, 339, 333

[56] References Cited

U.S. PATENT DOCUMENTS 4,873,403 10/1989 Counts et al. ..... 200/330
4,972,045 11/1990 Primeau ..... 174/66
5,105,059 4/1992 Sorenson et al. ..... 200/302.3
5,134,258 7/1992 Carrodus ..... 200/330
5,806,665 9/1998 Houssian ..... 200/330

*Primary Examiner*—Michael Friedhofer
*Attorney, Agent, or Firm*—Pearson & Pearson

[57] ABSTRACT

A sealed slide switch having a toggle mechanism with a handle extending through a housing into a cavity of a slide. An O-ring on the handle seals any opening between the base of the handle and the housing. A surface plate retains the slide of the switch on top of the housing. A plug in the bottom of the housing provides electrical connections between the toggle mechanism and an application circuit.

17 Claims, 5 Drawing Sheets

SEALED SLIDE SWITCH

BACKGROUND OF THE INVENTION

1. Field of the Invention

This patent relates generally to electrical switches and in particular to a sealed slide switch having a pivoting toggle type of operation.

2. Description of Related Art

Sealed switches are desired or often necessary for various applications where the switch needs to be sealed so that corrosives, dust, and other impurities in the atmosphere will not impair operation of the switch or shorten its useful life. Further, a sealed switch is required to protect a switch during certain component board processes such as wave soldering.

The sealing of slide switches has generally been accomplished by a secondary operation of installing a boot on the switch to protect it during various fabrication steps which otherwise would be damaging to the switch. Secondary operations add cost to these switches. Another approach is to provide a sealing means within the slide switch, but then the movement of the slide is not easy or smooth resulting in poor feel and inferior seal.

U.S. Pat. No. 4,191,387 issued Mar. 4, 1980 to Francis D. Kirchoff describes a water tight seal for toggle switches. The exterior of the switch housing is watertight by reason of a turn nut compressing an O-ring. The interior of the toggle switch handle housing is made watertight, while still permitting toggle motion, by an elongated seal of solid cross section engaging the outer face of a bulbous portion of the handle and a second elongated seal of solid cross section engaging the inner face of the bulbous portion.

U.S. Pat. No. 4,482,792 issued Nov. 13, 1984 to Leo Geremia describes a sealed toggle switch having an O-ring sealed in a groove of an upper surface of a base and extending around the periphery of the same. A lead actuator 50 includes an elongated ball portion and a ball which fits against a socket or bushing and is held against the O-ring to form a seal.

U.S. Pat. No. 4,731,511 issued Mar. 15, 1988 to Budd Steinhilber et al. describes a decorator wall plate and slide caps for positioning over a toggle-type electrical switch. A switch toggle lever protrudes through an opening in a wallplate and the slide member acts as a cam to exert force upon the switch toggle and move it from one position to another position. However, it does not disclose any sealing of the slide switches, and it does not have a method for accurate translation of the slide motion to the toggle motion.

U.S. Pat. No. 5,134,258 issued Jul. 28, 1992 to Melvin A. Carrodus describes a manually operated circuit breaker with sliding action for control and setting. A linkage member fits over a switch handle and is attached through a knurled pin to the handle. The linkage member slides right or left upon a flat surface of the housing. However, it does not disclose any sealing of the slide switch. Furthermore, in small switch configurations the use of a small pin to translate sliding motion to toggle motion results in a very fragile pin subject to breakage or damage when actuated.

SUMMARY OF THE INVENTION

Accordingly, it is therefore an object of this invention to provide a miniature sealed slide switch employing a toggle mechanism having an O-ring for accomplishing the seal.

It is another object of this invention to provide a sealed slide switch having a surface plate for enclosing a slide positioned on top of a housing to which the sides of the surface plate are snugly attached.

It is a further object of this invention to provide a sealed slide switch without the use of a boot.

It is still another object of the invention to provide a low cost miniature sealed slide switch having minimum components that are easily assembled.

It is another object of this invention to provide a miniature sealed slide switch for use on a printed circuit board during processes such as wave soldering.

It is still another object of this invention to provide a sealed slide switch with an easy movement and a positive feel.

These and other objects are further accomplished by a sealed slide switch comprising a housing, slide means positioned on top of the housing for enabling the switch to change from a first state to at least a second state, means positioned within the housing having a handle extending through an opening in the housing into a cavity within the slide means for switching the switch from the first state to at least a second state, means positioned on the handle of the switching means for sealing any space between the switching means and the housing, a surface plate, having an opening for an upper portion of the slide means to extend into the surface plate, positioned over the top of the housing and snugly attaching to the side walls of the housing, and means secured in a bottom opening of the housing for sealing the housing and providing electrical connections extending from the switching means. The slide enclosed by the surface plate moves linearly along the top of the housing in order to switch the switching means from a first state to at least a second state. The switching means comprises a toggle. The sealing means on handle of switching means comprises an O-ring. The surface plate comprises a pair of spaced apart prongs extending perpendicular to a side of the surface plate for securely mounting the switch to a circuit board. The surface plate comprises a prong extending on opposite sides of the slide switch perpendicular to the sides for stably mounting the slide switch.

The objects are further accomplished by a combination of a sealed slide switch having a housing with an opening in an upper end and an open lower end, a slide positioned on top of the housing, the slide having a cavity in an upper portion, a toggle having a handle extending through the opening in the upper end of the housing and into the cavity of the slide, an O-ring positioned on the handle of the toggle above a bulbous portion for sealing any space between the handle of the toggle and the opening in the upper end of the housing, a surface plate, having an opening for receiving the upper portion of the slide, positioned on the top of the housing and secured to opposite side walls of the housing, a terminal plug, having contacts mating with a clip portion of the toggle switch and secured in the open lower end of the housing, provides electrical connections outside the slide switch, and means placed over the terminal plug for sealing the lower portion of the switch. The slide enclosed by the surface plate moves linearly along the top of the housing in order to change the toggle from a first state to at least a second state. The terminal plug comprises cavities having sloping side walls in the top surface for receiving a spring-follower extending from the base of the toggle switch. The surface plate also comprises a pair of spaced apart prongs extending perpendicular to a side of the surface plate for securely mounting the switch to a circuit board. The surface plate comprises a prong extending on opposite sides of the slide switch perpendicular to the sides for stably mounting the slide switch.

The objects are further accomplished by a method of providing a sealed slide switch comprising the steps of providing a housing, positioning a slide means on top of the housing for enabling the switch to change from a first state to at least a second state, extending a handle of a switch means through an opening in the housing into a cavity within the slide means for switching the switch means from the first state to at least a second state, sealing any space between the switching means and the housing with means positioned on the handle of the switching means, positioning a surface plate, having an opening for an upper portion of the slide means to extend into the surface plate, over the top of the housing and snugly attaching to the side walls of the housing, and securing means in a bottom opening of the housing for sealing the housing and providing electrical connections extending from the switching means. The step of positioning the slide means on top of the housing comprises the step of linearly moving the slide means along the top of the housing in order to switch the switching means from a first state to at least a second state. The step of extending a handle of a switch means through an opening in the housing comprises the step of providing a toggle for the switching means. The step of sealing any spaces between the switching means and the housing comprises the step of using an O-ring. The step of positioning a surface plate over the top of the housing comprises the step of providing a pair of spaced apart prongs extending perpendicular to a side of said surface plate for securely mounting the switch to a circuit board. The step of positioning a surface plate over the top of the housing comprises the step of providing a prong extending on opposite sides of the switch surface plate perpendicular to the sides for stably mounting the slide switch.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
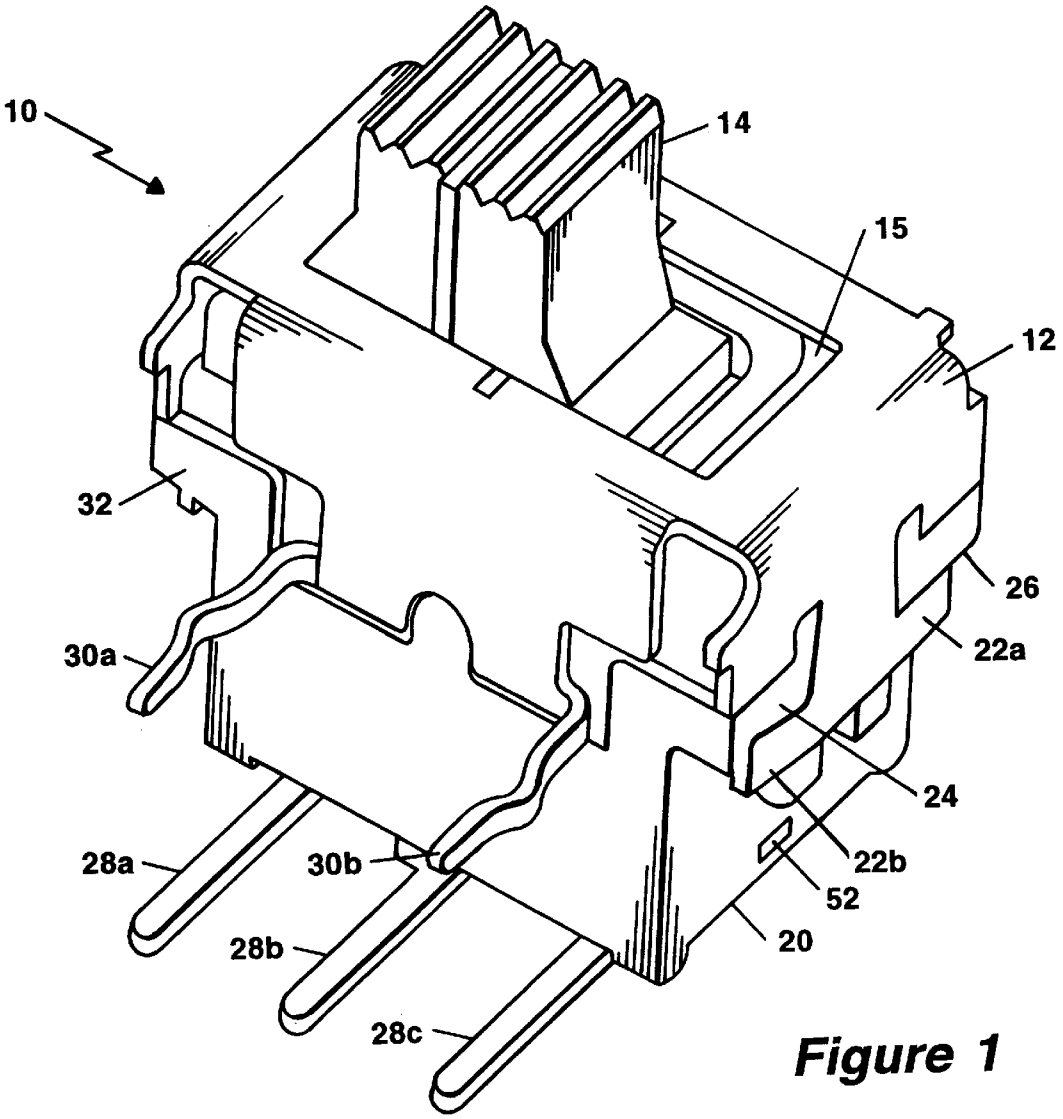
FIG. 1 is a perspective view of the invention of a sealed slide switch.
Figure 2:
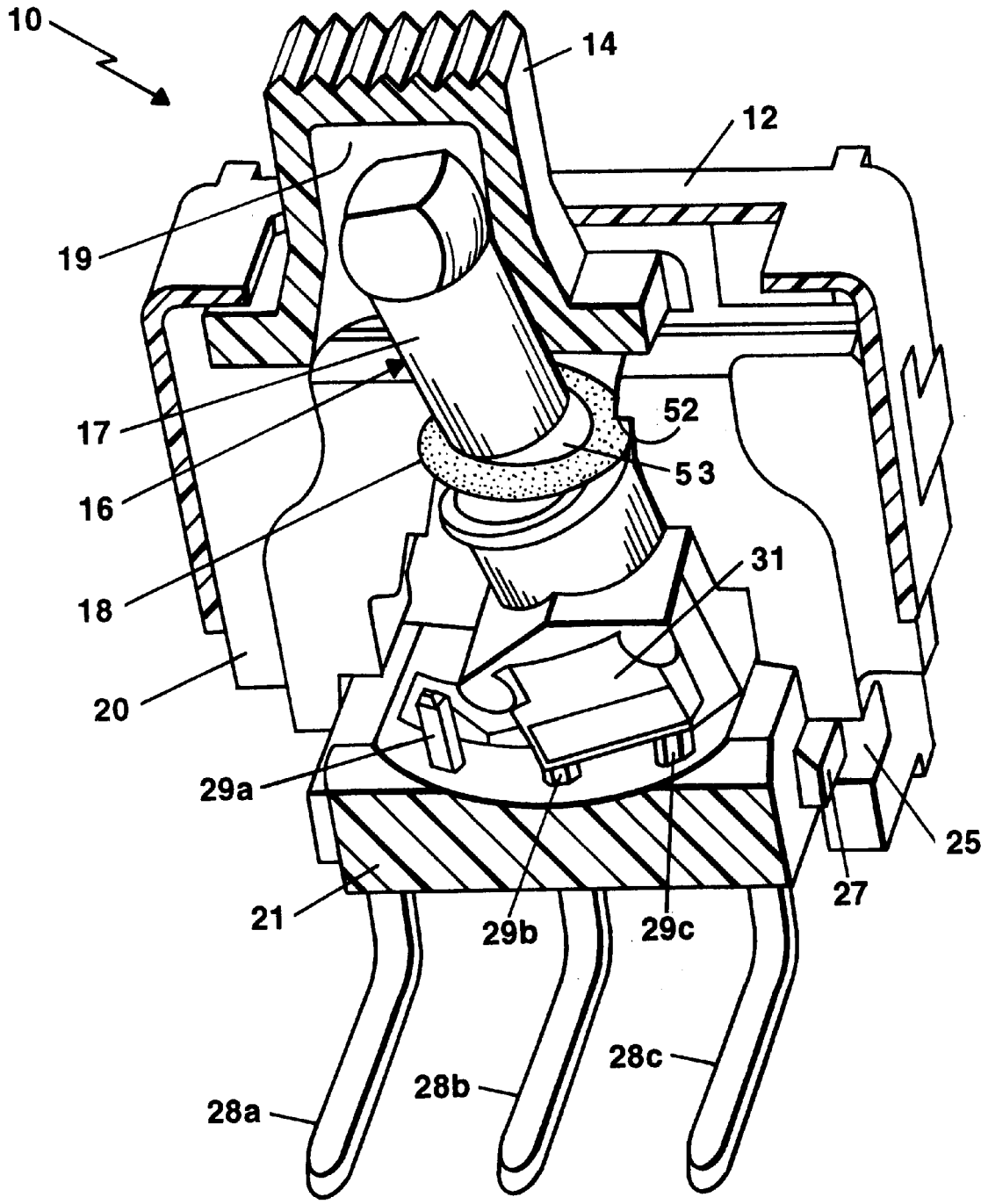
FIG. 2 is cut-away perspective view of the invention showing a toggle having an O-ring seal and a handle of the toggle positioned within a slide switch handle.

Referring to FIG. 1 and FIG. 2, FIG. 1 is a perspective view of the invention comprising a sealed slide switch 10 and FIG. 2 is a cut-away perspective view of the invention showing a toggle 16 comprising an O-ring 18 which is positioned at the base of a handle 17 above a bulbous portion 53 with the top portion of the handle 17 extending into a cavity 19 of a slide 14. The slide 14 is positioned on top of a housing 20, and a surface plate 12, having an opening 15 for the slide 14 to protrude through secures the slide 14 to the housing by side tabs 22*a* and 22*b* which are bent below the surface of islands 24, 26 on opposite sides of the housing 20. Terminals 28*a*, 28*b* and 28*c* extend from a bottom plug 21 of the housing 20 for connection, for example, to a circuit board. Spaced apart mounting prongs 30*a* and 30*b* extend from a side panel 32 of surface plate 12. They provide a means of stably mounting the slide switch 10, for example, on the circuit board.

FIG. 2 shows a cut-away perspective view of the sealed switch 10 of FIG. 1 showing a toggle 16 having an O-ring 18 at the base of its handle 17. A plug 21 inserted in the bottom of housing 20 keeps the toggle 16 positioned within switch 10 and provides external terminals 28*a*, 28*b*, and 28*c* and internal contacts 29*a*, 29*b*, and 29*c*.

Figure 3:
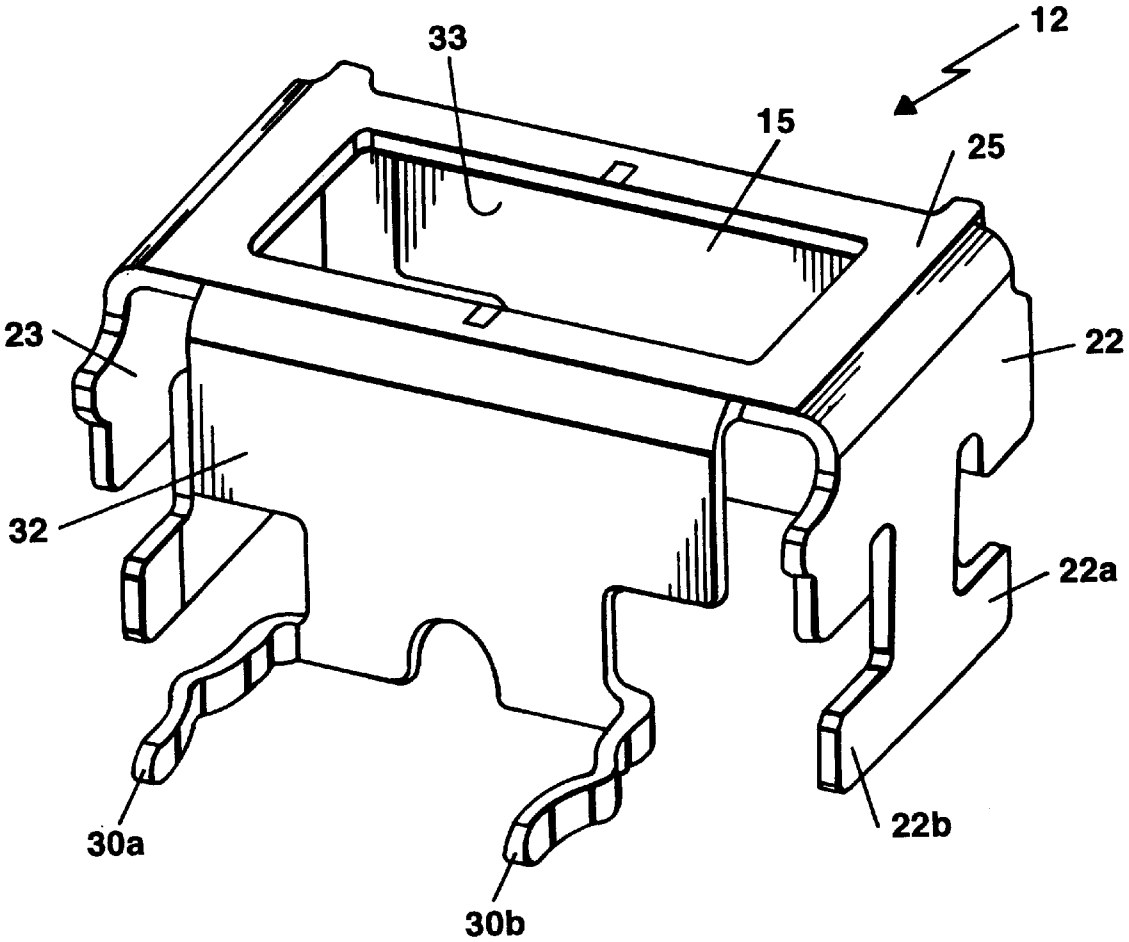
FIG. 3 is a perspective view of a surface plate of the invention having terminal on one side for securing the switch to a mounting board.
Figure 4:
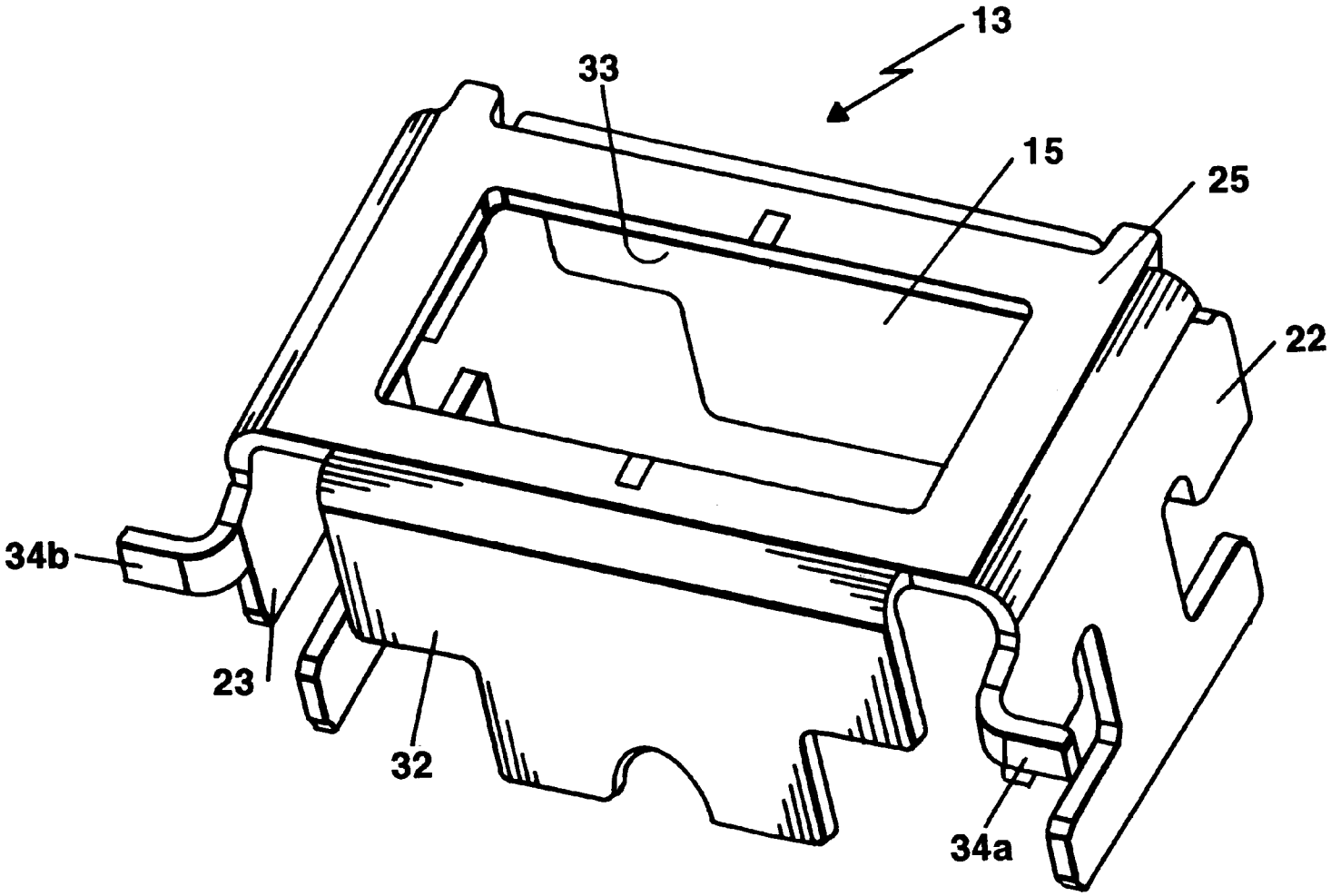
FIG. 4 is a perspective view of an alternate surface plate having two small terminals on each end of the surface plate.

Referring now to FIG. 3 and FIG. 4, FIG. 3 is a perspective view of the surface plate 12 in FIG. 1. The surface plate 12 comprises an opening 15 in a top surface 25 for receiving the slide 14 in the assembled slide switch 14 shown in FIG. 1. The surface plate 12 is a sheet metal part and the four sides are bent downward 90° relative to the surface 25 in order to form the shape shown in FIG. 3 and 4. However, the surface plate may be made of various other materials such as plastic. For the metal surface plate 12, two prongs 30*a* and 30*b* are bent outward perpendicular to the side panel 32. This method of producing the surface plate 12 provides a very low cost part. FIG. 4. is a perspective view of an alternate embodiment of a surface plate 13 of the invention which is similar to the surface plate 12. The difference between them is that prongs 34*a* and 34*b* are shorter and extend outward and perpendicular to sides 22 and 23 respectively. This difference provides for another type of switch mounting in an application. One will recognize that there are other configurations for prongs to extend from the sides of slide switch 10 depending on the particular application and mounting environment.

Figure 5:
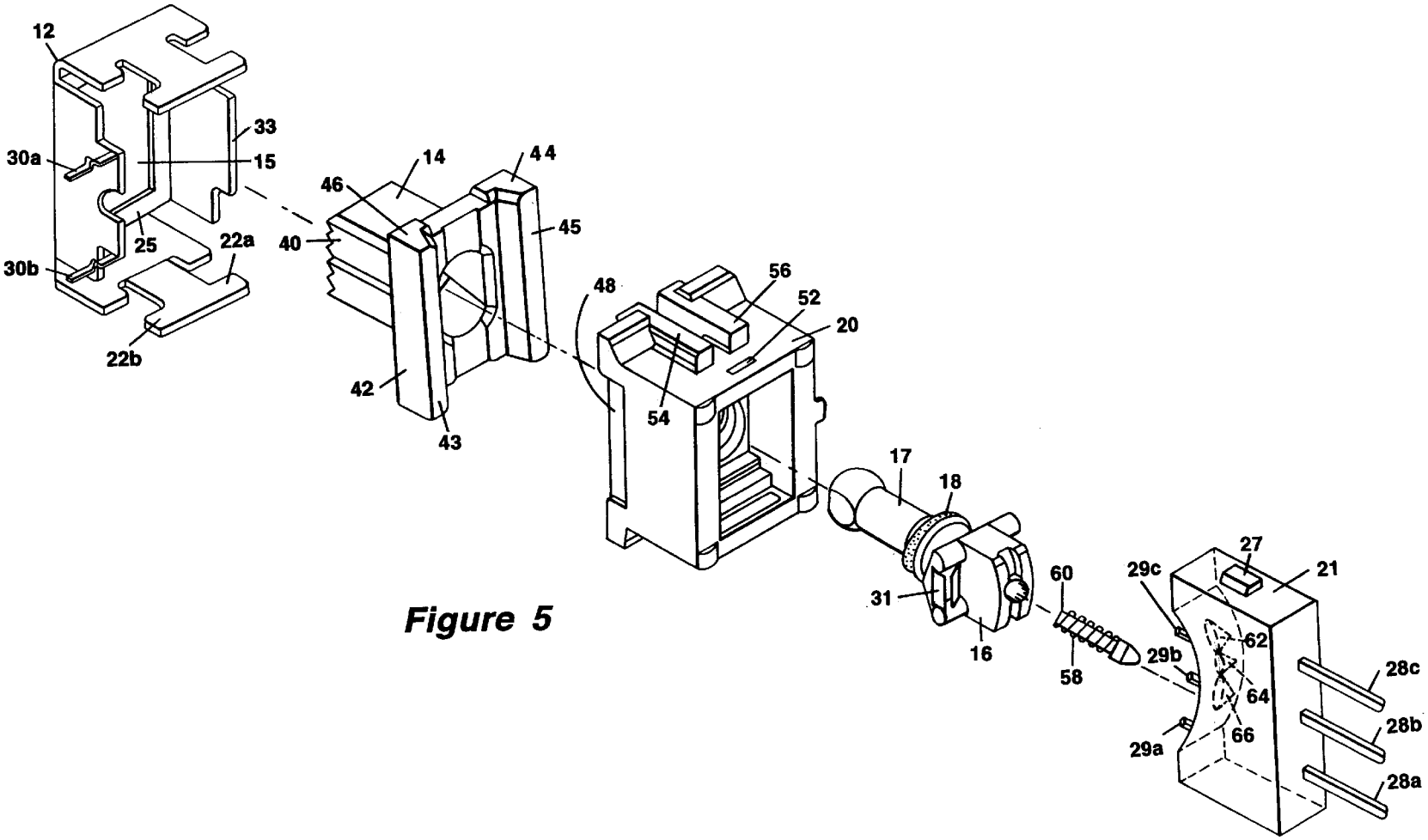
FIG. 5 is an exploded perspective view of the invention comprising a surface plate, a slide, a housing and a toggle with an O-ring and a terminal plug.

Referring to FIG. 5 an exploded perspective view of the sealed slide switch 10 invention is shown comprising the surface plate 12, the slide 14, the housing 20, the toggle 16 having the O-ring 18 and the terminal plug 21. This view clearly shows the order of assembly of the slide switch parts. The slide 14 has an upper portion 40 and a lower portion 42. Two opposite edges of the lower position 42 have downward extending flanges 43, 45 for engaging with recessed edges 48 on the top of housing 20. This arrangement provides a track for the slide to move back and fourth. The surface plate 12 is positioned on top of the slide 14 and sides of housing 20 and the upper portion 40 of slide 20 extends through the opening 15 of surface plate 12. Tabs 22*a* and 22*b* on one side of housing 20 and tabs 23*a* and 23*b* (not shown) on an opposite side of housing 20 secure the surface plate 12 to the housing 20 by bending them over downwardly tapering columns 54, 56.

Still referring to FIG. 5 and also FIG. 2, the toggle 16 is inserted into the housing 20 with the handle 17 extending through an oval opening (not shown) in the top of the housing 20 and protruding into the cavity 19 is the upper portion 40 of slide 14. The O-ring 18 at the base of the handle 17 is disposed between the bulbous portion 53 of handle 17 and a lip area 52 around said oval opening thereby filling any space between the base of the toggle handle 17 and the housing 20 and providing a seal. One of ordinary skill in the art will recognize that other shapes or designs of seals may be used in place of the O-ring 18 to accomplish filling such space. The toggle 16 comprises a switch clip 31 attached to a clip holder of toggle 16 for making and breaking contacts depending on the positions of the handle 17 of the toggle 16.

The bottom of the toggle 16 has a cylindrical hole for receiving a spring 58 which surrounds an upper cylindrical portion of a spring follower 60. The lower portion of spring follower 60 protrudes into one of cavities 62, 64, 66 in an upper concave surface of plug 21. Each cavity 62, 64,66 has V-shaped side walls enabling the lower end of follower 60 to easily move from one cavity to another when the slide 14 is moved across the top of switch 10. The cavities 62, 64, 66 provide a detent feeling for the slide switch 10.

Still referring to FIG. 5 and FIG. 2, a terminal plug 21 is inserted into the bottom of the housing 20 thereby closing up the slide switch 10. The terminal plug 21 comprises tapered tabs 27 extending outward on two opposite sides which snap into openings 52 provided in opposite sides of housing 20. The plug 21 comprises at least three external terminals 28*a*, 28*b*, 28*c* extending from the bottom of plug 21 and at least three internal contacts 29*a*, 29*b*, 29*c* which are connected to terminals 28*a*, 28*b*, 28*c* respectively. Another similar set of three external terminals and three corresponding internal contacts may be added to plug 21 when the switch application requires a double pole type. The contacts 29*a*, 29*b*, 29*c* are mounted in line with respect to each other and spaced apart such that two contacts will fit between the metal clip 31 in order to accomplish switching by continuity between two contacts. For example, when the toggle 16 is in the position shown in FIG. 2, the metal clip 31 connects contacts 29*b* and 29*c* together and when the toggle 16 is in the other position, metal clip 31 connects contacts 29*a* and 29*b* together. The upper surface of plug 21 from which the internal contacts 29*a*, 29*b*, 29*c* extend is concave to accommodate the convex surface of the bottom of toggle 16 as it moves from one position to another position. The plug 21 is made of plastic having internal wiring to accomplish the connection between the external terminals 28*a*, 28*b*, 28*c* and internal contacts 29*a*, 29*b*, 29*c*. Epoxy commonly known in the art seals the bottom of the slide switch housing 20 after the plug 21 is inserted.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. A sealed slide switch comprising:

a housing;

slide means positioned on top of said housing for enabling said switch to change from a first state to at least a second state;

means positioned within said housing having a handle extending through an opening in said housing into a cavity within said slide means for switching said switch from said first state to at least a second state;

means positioned on said handle of said switching means for sealing any space between said switching means and said housing;

a surface plate, having an opening for an upper portion of said slide means to extend into said surface plate, positioned over the top of said housing and snugly attaching to the side walls of said housing; and means secured in a bottom opening of said housing for sealing said housing and providing electrical connections extending from said switching means.

2. The sealed slide switch as recited in claim 1 wherein said slide enclosed by said surface plate moves linearly along the top of said housing in order to switch said switching means from a first state to at least a second state.

3. The sealed slide switch as recited in claim 1 wherein said switching means comprises a toggle.

4. The sealed slide switch as recited in claim 1 wherein said sealing means on said handle of said switching means comprises an O-ring.

5. The sealed slide switch as recited in claim 1 wherein said surface plate comprises a pair of spaced apart prongs extending perpendicular to a side of said surface plate for securely mounting said switch to a circuit board.

6. The sealed slide switch as recited in claim 1 wherein said surface plate comprises a prong extending on opposite sides of said slide switch perpendicular to said sides for stably mounting said slide switch.

7. In combination, a sealed slide switch having a housing with an opening in an upper end and an open lower end;

a slide positioned on top of said housing, said slide having a cavity in an upper portion;

a toggle having a handle extending through said opening in said upper end of said housing and into said cavity of said slide;

means positioned on said handle of said toggle above a bulbous portion for sealing any space between said handle of said toggle and said opening in said upper end of said housing;

a surface plate having an opening for receiving said upper portion of said slide, positioned on the top of said housing and secured to opposite side walls of said housing;

a terminal plug, having contacts mating with a clip portion of said toggle and secured in said open lower end of said housing, provides electrical connections outside said slide switch; and means placed over said terminal plug for sealing the lower portion of said switch.

8. The combination as recited in claim 7 wherein said slide enclosed by said surface plate moves linearly along the top of said housing in order to change said toggle from a first state to at least a second state.

9. The combination as recited in claim 7 wherein said terminal plug comprises cavities having sloping side walls in said top surface for receiving a spring-follower extending from the base of said toggle.

10. The combination as recited in claim 7 wherein said surface plate comprises a pair of spaced apart prongs extending perpendicular to a side of said surface plate for securely mounting said switch to a circuit board.

11. The combination as recited in claim 7 wherein said surface plate comprises a prong extending on opposite sides of said slide switch perpendicular to said sides for stably mounting said slide switch.

12. A method of providing a sealed slide switch comprising the steps of:

providing a housing;

positioning a slide means on top of said housing for enabling said switch to change from a first state to at least a second state;

extending a handle of a switch means through an opening in said housing into a cavity within said slide means for switching said switch means from said first state to at least a second state;

sealing any space between said switching means and said housing with means positioned on said handle of said switching means;

positioning a surface plate, having an opening for an upper portion of said slide means to extend into said surface plate, over the top of said housing and snugly attaching to the side walls of said housing; and securing means in a bottom opening of said housing for sealing said housing and providing electrical connections extending from said switching means.

13. The method as recited in claim 12 wherein said step of positioning said slide means on top of said housing comprises the step of linearly moving said slide means along the top of said housing in order to switch said switching means from a first state to at least a second state.

14. The method as recited in claim 12 wherein said step of extending a handle of a switch means through an opening in said housing comprises the step of providing a toggle for said switching means.

15. The method as recited in claim 12 wherein said step of sealing any spaces between said switching means and said housing comprises the step of using an O-ring.

16. The method as recited in claim 12 wherein said step of positioning a surface plate over the top of said housing comprises the step of providing a pair of spaced apart prongs extending perpendicular to a side of said surface plate for securely mounting said switch to a circuit board.

17. The method as recited in claim 12 wherein said step of positioning a surface plate over the top of said housing comprises the step of providing a prong extending on opposite sides of said switch surface plate perpendicular to said sides for stably mounting said slide switch.

* * * * *